US008118942B2

(12) United States Patent
Featherson et al.

(10) Patent No.: US 8,118,942 B2
(45) Date of Patent: Feb. 21, 2012

(54) DUST REMOVAL APPARATUS AND METHOD

(76) Inventors: David Featherson, Bundoora (AU); David Collins, Highton (AU)

( * ) Notice: Subject to any disclaimer, the term of this patent is extended or adjusted under 35 U.S.C. 154(b) by 234 days.

(21) Appl. No.: 11/575,567

(22) PCT Filed: Sep. 19, 2005

(86) PCT No.: PCT/AU2005/001413

§ 371 (c)(1),
(2), (4) Date: Mar. 19, 2007

(87) PCT Pub. No.: WO2006/029471

PCT Pub. Date: Mar. 23, 2006

(65) Prior Publication Data

US 2008/0060678 A1 Mar. 13, 2008

(30) Foreign Application Priority Data

Sep. 17, 2004 (AU) ..... 2004905335
Nov. 24, 2004 (AU) ..... 2004906680

(51) Int. Cl.
*B08B 5/02* (2006.01)
*B08B 5/04* (2006.01)
*B08B 1/02* (2006.01)

(52) U.S. Cl. ..... 134/15; 134/21; 134/34; 134/37; 15/301; 15/347

(58) Field of Classification Search ..... 134/15, 134/21, 122 R; 15/301, 345
See application file for complete search history.

(56) References Cited

U.S. PATENT DOCUMENTS 2,839,338 A * 6/1958 Arnold ..... 406/122
5,635,031 A * 6/1997 Enkvist ..... 162/199
5,636,031 A * 6/1997 Passoni ..... 356/394
6,176,898 B1 * 1/2001 Courtney et al. ..... 95/216
6,598,261 B2 * 7/2003 Howard ..... 15/308

FOREIGN PATENT DOCUMENTS

WO WO 98/19009 * 5/1998

* cited by examiner

*Primary Examiner* — Michael Kornakov
*Assistant Examiner* — Natasha Campbell
(74) *Attorney, Agent, or Firm* — Hogan Lovells US LLP

(57) ABSTRACT

A dust collecting installation for collecting airborne dust adjacent to a moving web. An elongate duct extends transversely to the direction of movement of the web and is positioned adjacent to the web. The duct is shaped and positioned so as to form an opening into the duct that receives at least a proportion of a layer of dust laden air adjacent to and moving with the web surface, and dust laden air is in turn withdrawn from the duct. The duct is positioned and so shaped that air flow into the opening is augmented by a jet of air generated where the moving surface converges with and comes into contact with a surface of a roller which the web passes over and contacts.

17 Claims, 10 Drawing Sheets

DUST REMOVAL APPARATUS AND METHOD

This application is the U.S. National Phase under 35 U.S.C. §371 of International Application PCT Patent Application No. PCT/AU2005/001413, filed on Sep. 19, 2005, which claims priority to Australian Patent Application No. 2004905335 filed on Sep. 17, 2004 and Australian Patent Application No. 2004906680 filed on Nov. 24, 2004, the contents of which are all herein incorporated by this reference in their entireties. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

TECHNICAL FIELD OF THE INVENTION

The invention relates to improved dust removal apparatus for controlling airborne dust in the vicinity of moving services and particularly moving webs, with particular application to machinery for handling paper.

BACKGROUND ART

Machinery that provides for the continuous transport of dry webs of paper over multiple rollers and other components where the web's direction changes can be the cause of substantial dust generation. Dust that accumulates on the machinery can interfere with correct operation, lead to product quality problems in some circumstances, hinder maintenance, and may also present a fire hazard. Dust that is transferred into the air can also represent a fire hazard, and additionally can be breathed by workers.

Much effort has been directed to the development of dust hoods for sucking dust laden air from parts of such machines. However, such devices are themselves imperfect in operation and can require substantial power consumption.

In some applications it is important to remove entrained dust from air in the vicinity of a moving web and to remove dust from the web itself. This is commonly done by dust hoods and the like that use a combination of directed jets of air provided by a compressor and suction applied near the moving web.

Such installations are usually provided at critical points in the path of a moving web, for example near doctor blades that crepe (separate) a web of paper from the surface of a so-called Yankee drum. However, there are often locations in paper making and handling machinery where significant dust is generated by, for example, being entrained in a "boundary layer" of air moving with the web close to its surface or by being thrown off the web near rollers and the like, where it is undesirable or difficult to provide elaborate, costly, high-power consuming and bulky dust removal equipment.

There is thus a need for a method of controlling dust at such locations without these disadvantages or in which they are reduced. The present invention provides apparatus and methods which address this problem.

It is believed that the concepts are not limited in their application to paper processing machinery only.

STATEMENT OF THE INVENTION

The invention provides in a first aspect dust collecting apparatus for use in collecting airborne dust adjacent to a moving surface, the apparatus comprising:

an elongate duct extending in a direction transverse to a direction of movement of a moving surface and spaced apart from the surface, the duct having along its length at least one opening permitting entry of air into the duct; and air extracting means in fluid communication with an interior space of the duct and adapted to draw air therefrom, wherein said apparatus is positionable adjacent to the moving surface so that the apparatus and the moving surface define an air inlet into which is received at least a proportion of a layer of dust laden air adjacent to and moving with the moving surface at least some of said air being drawn into the duct.

The invention emphasizes collection of airborne dust rather than the active dislodging of dust from a moving web surface, and this can lead to less power consumption, through for example avoidance of the use of compressed air, and the advantageous use of the momentum of air that is moved by the traveling web itself and (as discussed below) parts of the machinery.

In the preferred embodiment, the or a said opening is shaped and positioned so that air enters the duct in a direction approximately tangential to an inner surface of the duct and so that air in the duct moves both rotationally about the length of the duct and longitudinally along the duct. That is a votex motion is induced in the air entering the duct. This aids in keeping the dust entrained so that it is less likely to settle in, and so to foul, the duct.

A scroll-like arrangement may be used for the duct in this case. Specifically, the or a said opening of the duct when seen in section transverse to the length of the duct may comprise a flow passage defined on one side by a first wall extending inwardly of the duct to a free edge of the first wall and on an opposite side by a second wall extending outwardly of the duct, one side of the first wall partially defining the inner surface of the duct.

The said duct may be formed from a tubular member having a wall in which a longitudinal cut is made and a part of the wall is deformed inwardly to form the said first wall. This is useful as the construction of the duct can be comparatively low cost.

Preferably, the or a said flow passage is elongate in the lengthwise direction of the duct and of varying width along its length.

Instead of one slot-like opening, the duct may have a plurality of said openings. Members of the said plurality of openings may be of varying sizes, again so as to provide for control of the flow rate distribution.

Preferably, the first wall is so shaped and sized and the air flow rate in the duct is able to be so chosen that in use in a specified position of the duct relative to the moving surface that air passing the free edge of the first wall in the said flow passage and air passing the said free edge inside the duct travel in substantially the same direction as seen in section transverse to the length of the duct. That is, air flowing past the edge, or "lip" of the first wall should preferably not have to turn sharply when passing beyond the lip. This can be achieved through testing or computation fluid dynamics simulation, and is found to work well.

Desirably, the or each said opening is so sized and proportioned that in use in a specified position of the duct relative to the moving surface and with a specified air flow rate in the duct a specified distribution of air flow rate per unit duct length is obtained along the length of the duct, preferably a constant air flow rate per unit duct length. This can be achieved in designing the apparatus for a given application by testing, or by computer simulation.

The air extracting means may be connected to the duct at either end or both ends of the duct. Alternatively, the connection may be made at an intermediate point along the length of the duct although this is generally less convenient. Air may be drawn from the duct by the extraction means tangentially or axially.

The dust collecting apparatus may comprise a downstream formation having an edge that is elongate in the direction along the length of the duct the edge being positionable adjacent to the moving surface and in use of the apparatus being passed by a point on the moving surface after the point passes a said opening of the duct. (That is, the term "downstream" is here being used to refer to the direction of movement of the moving surface.)

The apparatus may further comprise an upstream formation elongate in the direction along the length of the duct, the upstream formation and the moving surface defining a space therebetween and in use of the apparatus air being drawn from the said space into the duct, the upstream formation being encountered by a point on the moving surface before the point passes a said opening of the duct. The use of an upstream formation can give more flexibility in actual installations.

In one embodiment, the upstream formation has a leading edge defined by upper and lower surfaces that diverge backwardly therefrom. The said lower surface may extend from the said leading edge to a point on the duct adjacent to a said opening.

It has been found particularly desirable that the dust collecting apparatus further comprise movable support means whereby the apparatus is movable relative to the moving surface. This can greatly assist when access for maintenance (including threading of paper webs, for example, where the application is to paper-handling machinery) is required or to allow correct operation of the apparatus for different modes of operation of the machine to which it is fitted.

The movable support means preferably comprises mechanical actuators supporting opposite ends of the apparatus.

The movable support means is preferably operable to move the apparatus towards and away from the moving surface, and optionally to rotate the apparatus about an axis that extends parallel to the length of the duct.

The invention provides in a further aspect a dust collecting installation in equipment in which a continuous web is transported along its length, the installation comprising dust collecting apparatus according to any of the forms disclosed herein and a surface of the web being the said moving surface, wherein the apparatus is so sized proportioned and positioned and the air extraction means is operated at such an air flow rate that a specified proportion of dust entrained in air moving with the moving surface is drawn into the duct. This proportion may be high, for example more than about 80%, preferably about 90% and more preferably approximately 100%. A user may measure the thickness and dust mass distribution of the moving "boundary layer" of air close to a moving web and provide an installation tailored to extract most of the dust in that layer. This may include providing that the rate of air flow into the duct per unit duct length is approximately constant across the width of the web.

A dust collecting installation can be provided wherein in the said equipment the web passes over a cylindrical roller and the dust collecting apparatus is on the opposite side of the web from the roller, the installation including a guide formation having a cylindrical surface concentric with and facing inwardly towards an axis of rotation of the roller and extending from a leading edge around said axis to said apparatus so that air moving with the surface and dust entrained therein are guided around said roller and drawn into the duct. The guide formation may conveniently be formed from sheet material.

A dust collecting installation can be provided wherein in the said equipment the web passes over a cylindrical roller and the dust collecting apparatus is on the same side of the web as the roller, the installation being characterized in that the or a said duct opening is so positioned that a jet of air generated where the web first contacts the roller augments air flow into the or a said opening of the duct. This use of such windage generated by the machinery is an extension of the invention's use of the momentum of the "boundary layer".

The upstream formation, where provided, may define a leading edge elongate in the direction along the duct length and the apparatus may be so positioned that the minimum distance between the leading edge and the moving surface is greater than the minimum distance between the downstream formation edge and the moving surface. In effect such an installation may be visualized as "swallowing" the dust-laden boundary layer. The said minimum distance between the leading edge and the moving surface may be a specified proportion of the height of a boundary layer of air moving with the moving surface.

In a further aspect, the invention provides a method for limiting dust concentration in machinery in which a web is transported along its length comprising the steps of providing and operating a dust collecting installation according to any one of the embodiments disclosed herein at at least one position along the length of the web. The invention allows for the possibility at reasonable cost of providing dust-control installations at multiple positions along the web path.

It is to be explicitly understood that not all the concepts described herein and believed to be inventive are set out above. Others are set out in the following detailed description.

In order that the inventive concepts may be better understood there will now be described, non-limitingly, certain preferred embodiments as shown in the attached Figures, of which:

DETAILED DESCRIPTION OF PREFERRED EMBODIMENTS

Figure 1:
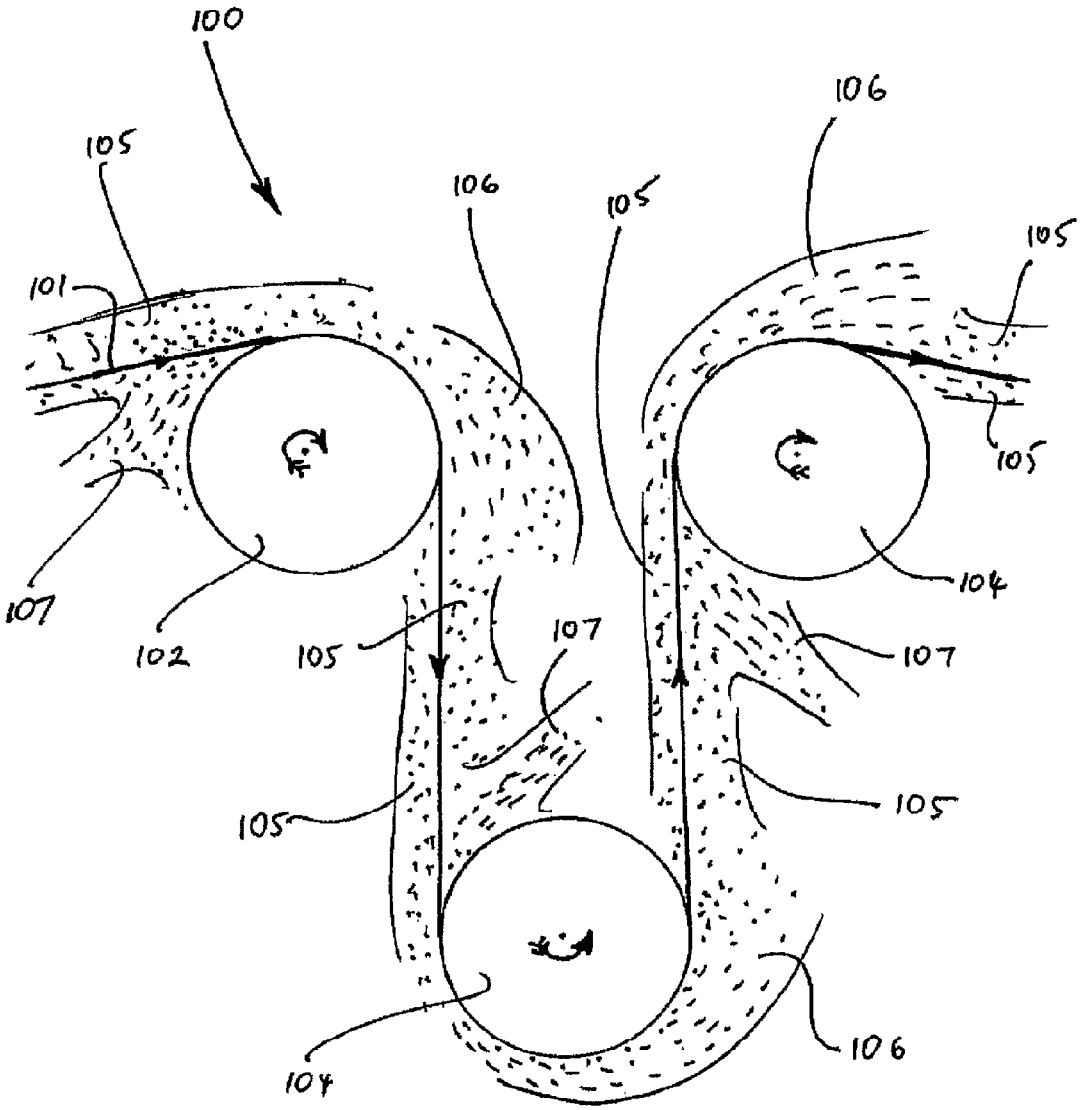
FIG. 1 is a side view of part of a machine handling a continuous web with dust thereon.

FIG. 1 is a side view of a part of a machinery installation 100 of a type where the present invention may be applied. The installation 100 could be part for example of a machinery installation for making multi-ply toilet tissue. A web 101 of paper passes sequentially over three rollers 102, 103 and 104, changing direction at each stage. A typical distribution of airborne dust around the web is shown very approximately (i.e. not exactly) using dots and possible contours of equal dust concentration, as follows. Arrows 105 show dust in "boundary layers" of air that move with the web 101 along unsupported lengths of the web 101. Arrows 106 show where dust is thrown outward from the web 101 as it changes direction. Arrows 107 show jets of air generated where the web 101 and surfaces of each of rollers 102, 103 and 104 approach each other to form internal corners. This general pattern has been established by testing.

Figure 2:
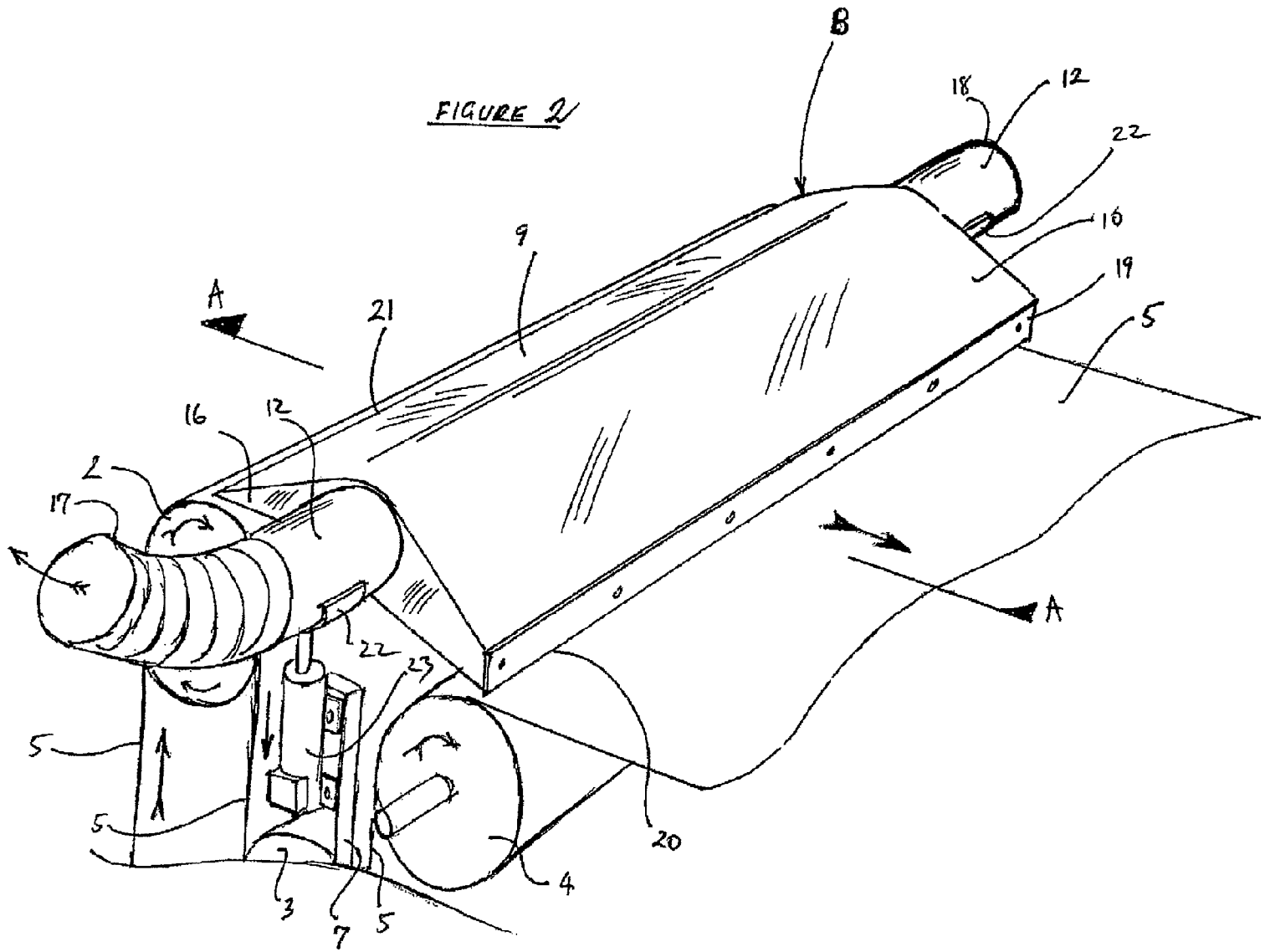
FIG. 2 is a perspective view of a hood that embodies inventions described herein.
Figure 3:
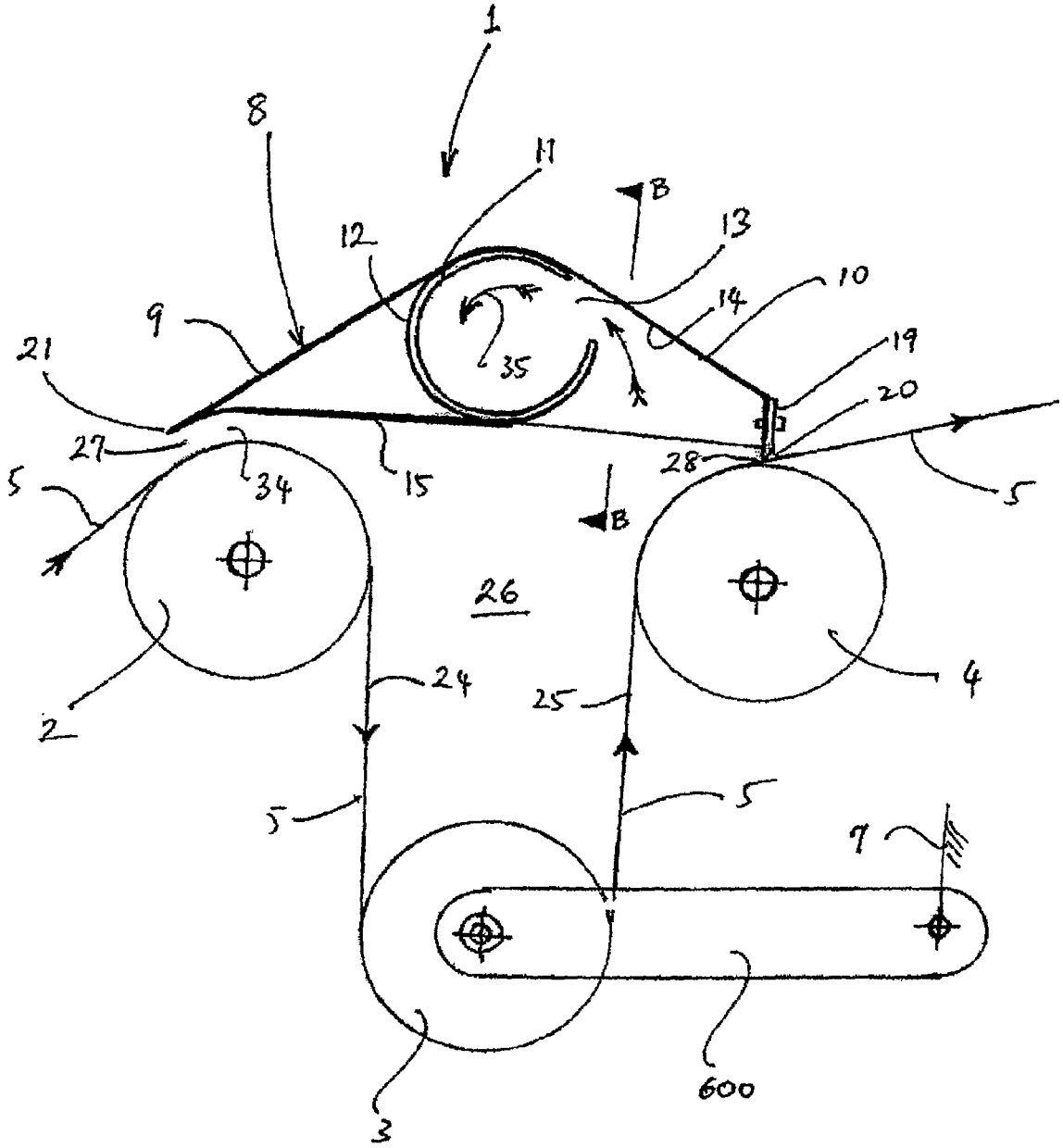
FIG. 3 is a cross-sectional view of the hood of FIG. 2, the section being taken at station "AA"
Figure 4:
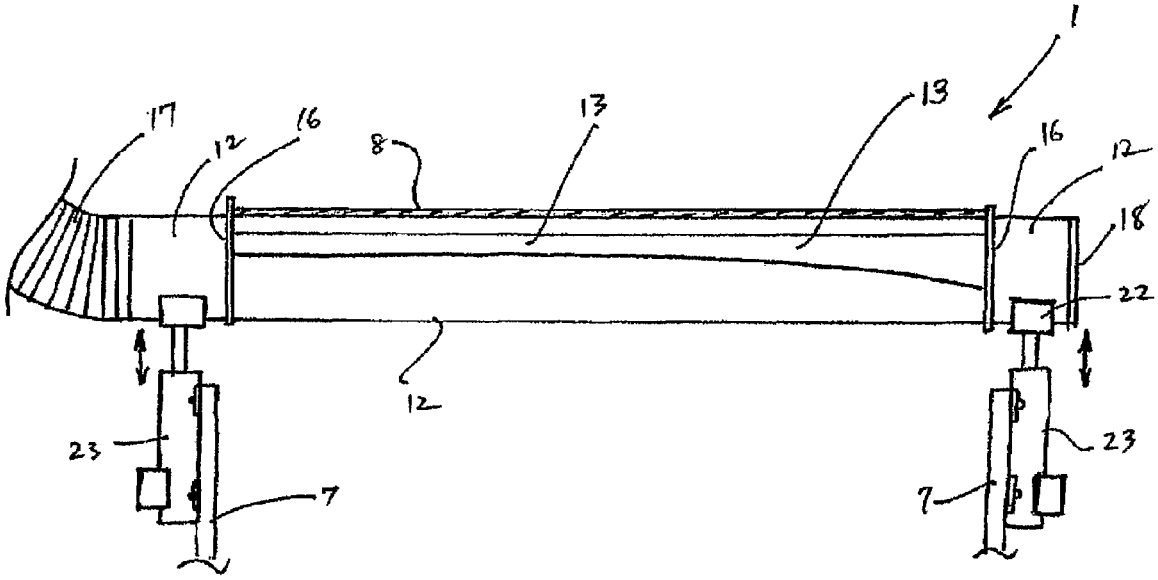
FIG. 4 is a cross-sectional view of the hood as shown in FIG. 3, the section being taken at station "BB" and omitting certain parts.

FIGS. 2-4 show a dust removal hood 1 installed adjacent to three generally cylindrical rollers 2, 3 and 4 that guide a moving web 5 of paper in machine section 6. Rollers 2 and 4 are fixed in position, and roller 3 is an idler secured at each end on radius arms 600 pivotally mounted to a fixed frame 7 of machine section 6 so that roller 3 can be moved to take up slack in, and apply tension to, web 5 in known manner.

Hood 1 is not intended necessarily to remove both airborne dust and dust embedded in web 5, but rather to remove or reduce airborne dust, except where dust embedded in web 5 happens to be dislodged where it is working, for example by being thrown off as mentioned above in relation to FIG. 1.

The use of this particular example is not intended to limit the scope of the inventions here disclosed. The inventions are considered to be potentially applicable to many machinery installations where a moving web carries dust on its surface and/or embedded in it and/or entrained in moving air adjacent to its surface. It is believed that the present inventive concepts may be applicable in applications other than paper processing and manufacture.

Unless removed, dust on or around webs such as web 5 may represent a respiratory or fire hazard, or may collect in undesirable quantities on or around the machine section 6. By various mechanisms, dust on or in the web 5 may be transferred into the surrounding air as the web passes over rollers 2, 3 and 4.

Hood 1 is mounted above rollers 2 and 4, and extends between them and lengthwise along them.

The construction of hood 1 between its ends is best seen in the cross-sectional view of FIG. 3. An outer cover 8 has a front section 9 and a rear section 10 meeting arranged in a shallow inverted "V" formation. Secured below cover 8 is a duct 12, of substantially circular cross-section that extends longitudinally of hood 1 and that has an elongate slot 13 in its wall 11. The slot 13 has a width that varies along the length of duct 12, and is adjacent to a lower surface 14 of rear section 10 of outer cover 8. A lower wall 15 extends rearwardly from a leading edge 21 and is secured to wall 11.

End plates 16, parallel to each other, are secured to opposite ends of outer cover 8 and of lower wall 15. Duct 12 is secured to and extends through each end plate 16. Slot 13, however, only extends between end plates 16, so that outside them duct 12 is simply a closed circular duct. The distance between end plates 16 is slightly greater than the length of rollers 2 and 4 so that rollers 2 and 4 can in use of hood 1 be positioned partially within hood 1.

Air and entrained dust is sucked from under hood 1 through duct 12. To this end, a flexible hose 17 is secured to duct 12 in known manner at one end of duct 12 and connects hood 1 to the inlet of a suitable blower or fan (not shown). A blanking plate 18 is provided at the other end of duct 12, although if required in a particular application, it would of course be possible to provide instead of plate 18 a second hose (not shown) similar to hose 17.

Depending from a rear edge 18 of rear section 10 of cover 8 is a wad catcher plate 19, whose lower edge 20 is in use positioned adjacent to an upper surface of web 5 where it passes over roller 4. Provision of a wad catcher 19 integral with hood 1 is advantageous in that dust accumulation on the front face of wad catcher 19 is limited. Referring to the toilet paper manufacturing application (FIG. 1) wad catcher plate 19 would be used in particular to remove dust or lumpy material from the side of web 5 that is to be joined to another ply. In other applications, a wad catcher plate 19 might not be required.

Lower wall 15 and front section 9 meet at an acute angle at a leading edge 21 of hood 1. Leading edge 21 is in use of hood 1 positioned adjacent to an upper surface of web 5 where it passes over roller 2.

It will be noted that lower wall 15, front section 9 of upper cover 8 and wall 11, being connected, together define a closed shape so that hood 1 inherently has substantial torsional stiffness, a desirable feature. The duct 12 by itself, with or without cover 8, would of course provide much less torsional stiffness due to the presence of slot 13.

Hood 1 is supported as follows. Saddles 22 are provided to support duct 12 at each end of hood 1 where it protrudes beyond end plates 16. Each one of saddles 22 is able to be raised and lowered as required, using one of two actuators 23. Each actuator 23 is a screw jack type operated by an electric motor. Such actuators are available commercially, and particularly suitable ones are able to provide close control of the position of a load such as hood 1. Actuators 23 are secured to parts of the fixed frame 7.

By means of actuators 23, hood 1 can be raised above rollers 2 and 4 sufficiently far for access when web 5 is to be threaded through machine section 6 and for general maintenance and/or cleaning. Thereafter hood 1 can be lowered accurately to, and held in, a working position of hood 1, as shown in FIG. 3, wherein leading edge 21 and the wad catcher lower edge 20 are adjacent to web 5.

Although in the interests of clarity not shown in FIGS. 2 to 4, parallel blocking plates may be secured to frame 7 and placed close to each end of rollers 2, 3 and 4 to ensure that airflow into duct 12 through slot 13 is substantially in planes parallel to the direction of motion of web 5 with little airflow entering between runs 24 and 25 of web 5 near the web's edges. That is, hood 1 in its working position, the upper surface of web 5, and the blocking plates define a nearly-closed space 26 in fluid communication with duct 12. The gaps 27 and 28 between edges 21 and 20 and web 5 of course allow some air flow into space 26.

In the sectional view of FIG. 4, rear section 10 of cover 8 is omitted, so that the whole of duct 12 can be seen. This Figure best shows the variation in width of slot 13 required to obtain a uniform air flow rate into duct 12 across the width of web 5.

Generally, it is found that a moving web 5 (especially of dry paper toilet-type tissue) causes a body of air to move lengthwise with the web 5, that body of air carrying a burden of dust.

Figure 5:
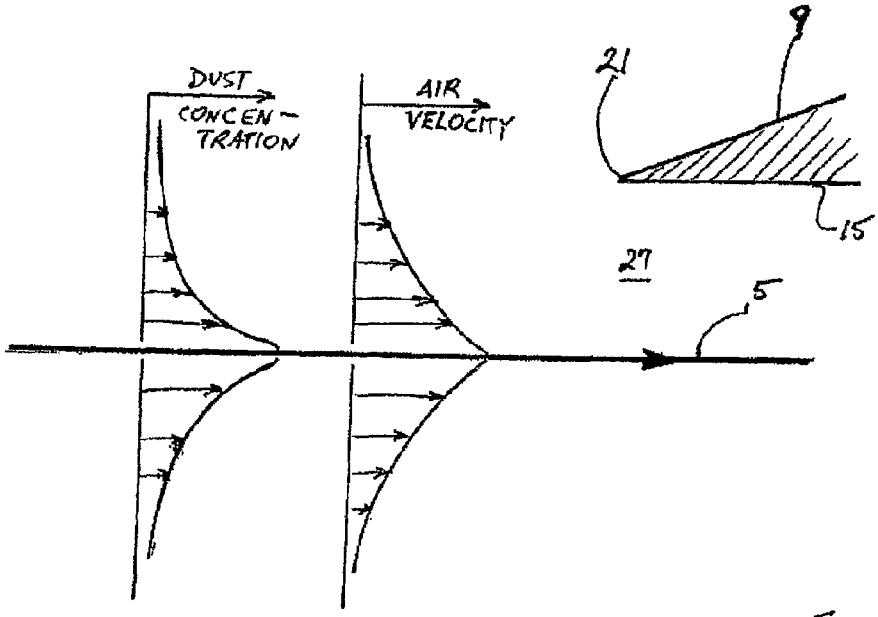
FIG. 5 is a schematic side view of the leading edge of the hood and web of FIG. 2, with dust conventration and velocity gradients near the web shown.
Figure 6:
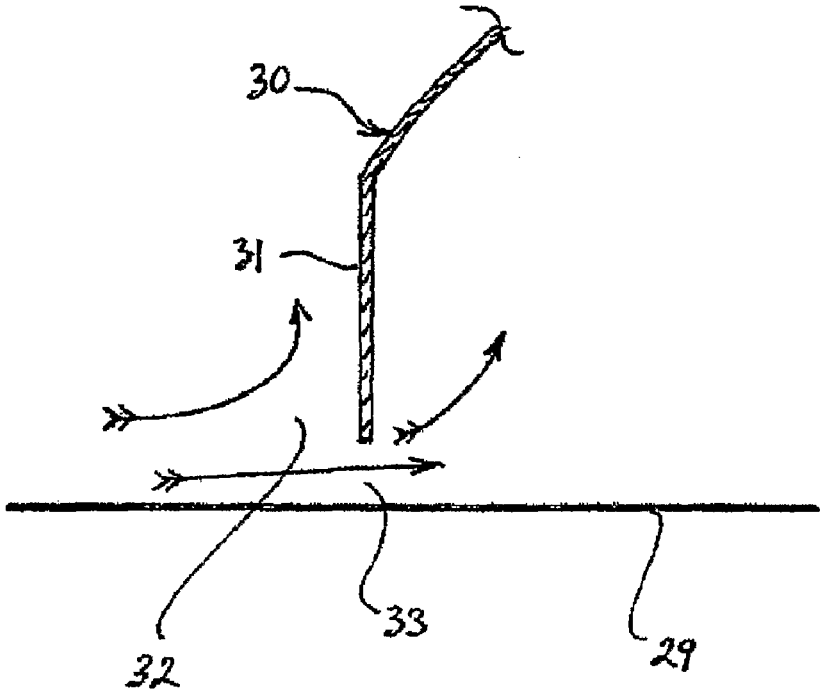
FIG. 6 is a cross-sectional sideways-looking view of a further hood leading section and a web.

As shown in FIG. 5, the concentration of dust will vary with distance from each surface of web 5. There will also be a progressive reduction of lengthwise velocity of the air with increased distance from the web surface, i.e. there will be a moving "boundary layer" of dust laden air. The working position of hood 1 is chosen so that the leading edge 21 is spaced from web 5 by a distance so chosen that a suitably large proportion of the dust entrained in the boundary layer passes into the hood. The flow rate of airborne dust into the hood through gap 27 is the product of the mean velocity and concentration to the height of the gap. Note that additional dust is usually carried in the web itself, and a proportion of this is in general expelled into space 26, for example when the web 5 passes over roller 3. The acuteness of the angle between the front section 9 of cover 8 and lower wall 15 is provided to limit any tendency to develop a region of stagnant flow at the front of hood 21. FIG. 6 shows the condition to be avoided as far as possible, a web 29 passing below a hood 30 with a wall 31 at its leading end that extends normally to web 29. Dust can accumulate in a stagnant region 32 developed in front of hood 30, all the more so when a small gap 33 between hood 30 and web 29 is chosen to minimize the required air flow in the hood 30.

Lower wall 15 is so shaped that in the working position of hood 1 there is only limited variation in the distance between web 5 and lower 15 in the region 34 behind leading edge 15. This lessens deceleration of air after it passes through gap 27 by comparison with the deceleration that would happen if hood 1 did not include lower wall 15 (as is the case in hood 30). Such deceleration could also lead to undesirable accumulation of dust under hood 1.

The arrangement (as seen in cross-section) of duct 12 with its inlet slot 13 positioned under rear section 10 of cover 8 promotes vortex flow of air within duct 12 superimposed on the longitudinal flow of air within duct 12. Arrow 35 in FIG. 3 shows the rotational direction of the vortex flow. Such vortex flow is advantageous, in tending to draw dust towards the center of duct 12 and away from the walls, where it might otherwise tend to accumulate. It is thought that where cyclone-type separator is provided downstream of the duct 12, vortex flow in duct 12 may be advantageous in enhancing the dust-separating effectiveness of the cyclone separator.

Figure 9:
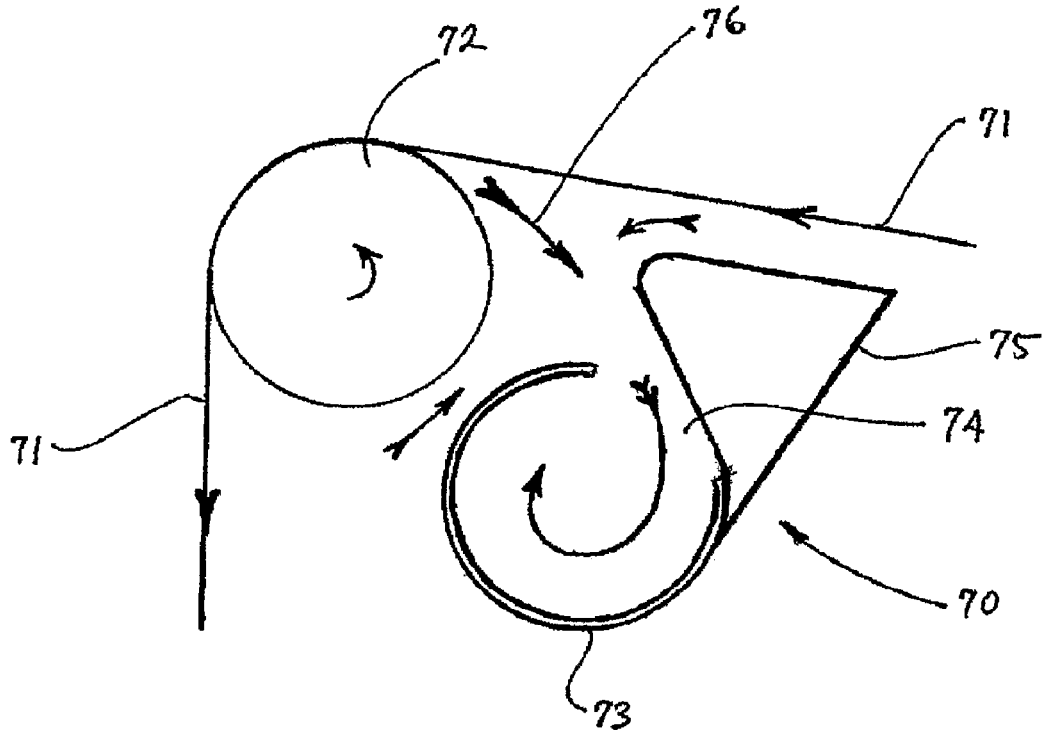
FIG. 9 is a cross-sectional view (looking transversely across a web) of a further hood in association with rollers and the web.

Note that hoods based on the principles set out herein may be made to suit other parts of web-transporting machinery. For example, FIG. 9 (which is comparable for interpretation purposes to FIG. 3) shows a cross-section of a hood 70 suitable for dust removal on the inner side of a web 71 passing over a roller 72. A duct 73, having a lengthwise slot 74 is again provided, and a formation 75 that is elongate and extends parallel to the length of roller 72 supports duct 73. Formation 75 is also shaped to guide air into duct 73 as indicated by arrows in FIG. 9. It has been found that in at least some circumstances a "jet" of air is forced away from the point where web 71 converges with roller 72, this jet being represented by arrow 76. Slot 74 is positioned so that this jet flows substantially directly into slot 74, and is compatible with the rotational direction direction of the vortex flow induced in duct 73 by the positioning of slot 74. Generally, hood 70 is arranged so that the vortex flow induced in duct 73 is compatible with the flow around the exterior of duct 73 and around roller 72, thus limiting flow losses and consequently the power requirements for clearing the dust laden air.

Figure 10:
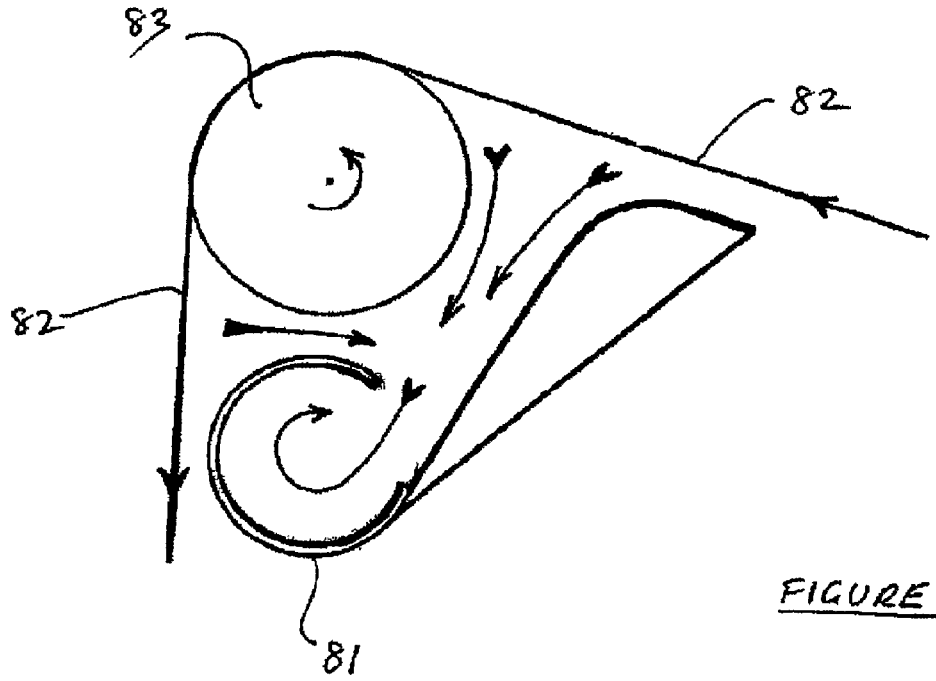
FIG. 10 is a cross-sectional view (looking transversely across a web) of a still further hood in association with rollers and the web.

FIG. 10 is a comparable view of another hood 80 operating on a similar principle. In this case, a duct 81 is placed closer to web 82 on the exit side of roller 83.

Figure 11:
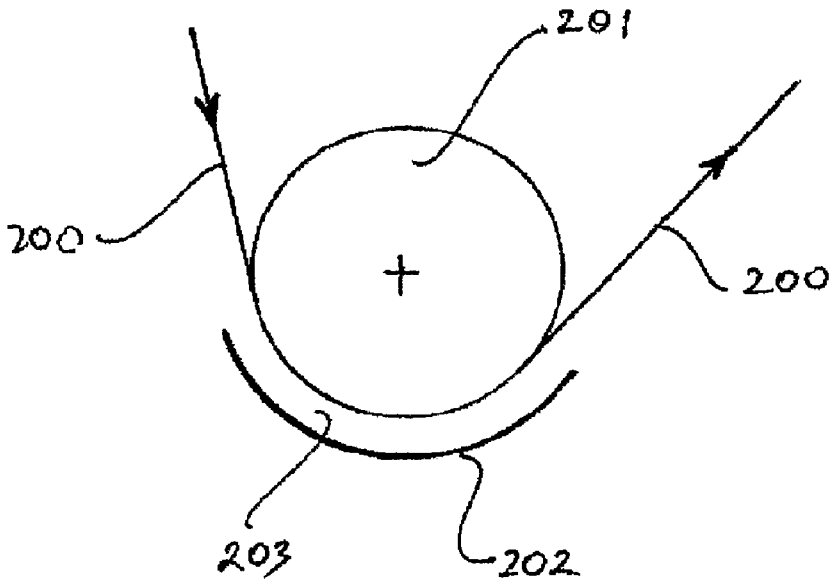
FIG. 11 is a cross-sectional view (looking transversely across a web) of a inventive guide in association with a roller and the web.

It is of course not desirable to provide a complete dust removal hood at every conceivable location on a large machinery installation, on cost and accessibility grounds. It has been found that at some locations it is beneficial to provide a simple shaped air flow guide formed from sheet material at locations adjacent to moving webs, and particularly where webs pass over rollers. As an example, FIG. 11 shows a side view of a web 200 passing over a roller 201, with a guide 202 formed from sheet material supported adjacent to web 200. Guide 202 is elongate and extends along the length of roller 201. Guide 202 is shaped and positioned so that there is an approximately constant gap 203 between web 200 and guide 202. It has been found that guide 202 can in at least some applications limit the otherwise noticeable tendency of dust to spread outwardly (in larger quantities than elsewhere along web 200) at roller 201. Without any intention to be held to a particular explanation, it is thought that air carried along by the moving web 200 is assisted to flow around the curved path in gap 203 by guide 202.

Figure 12:
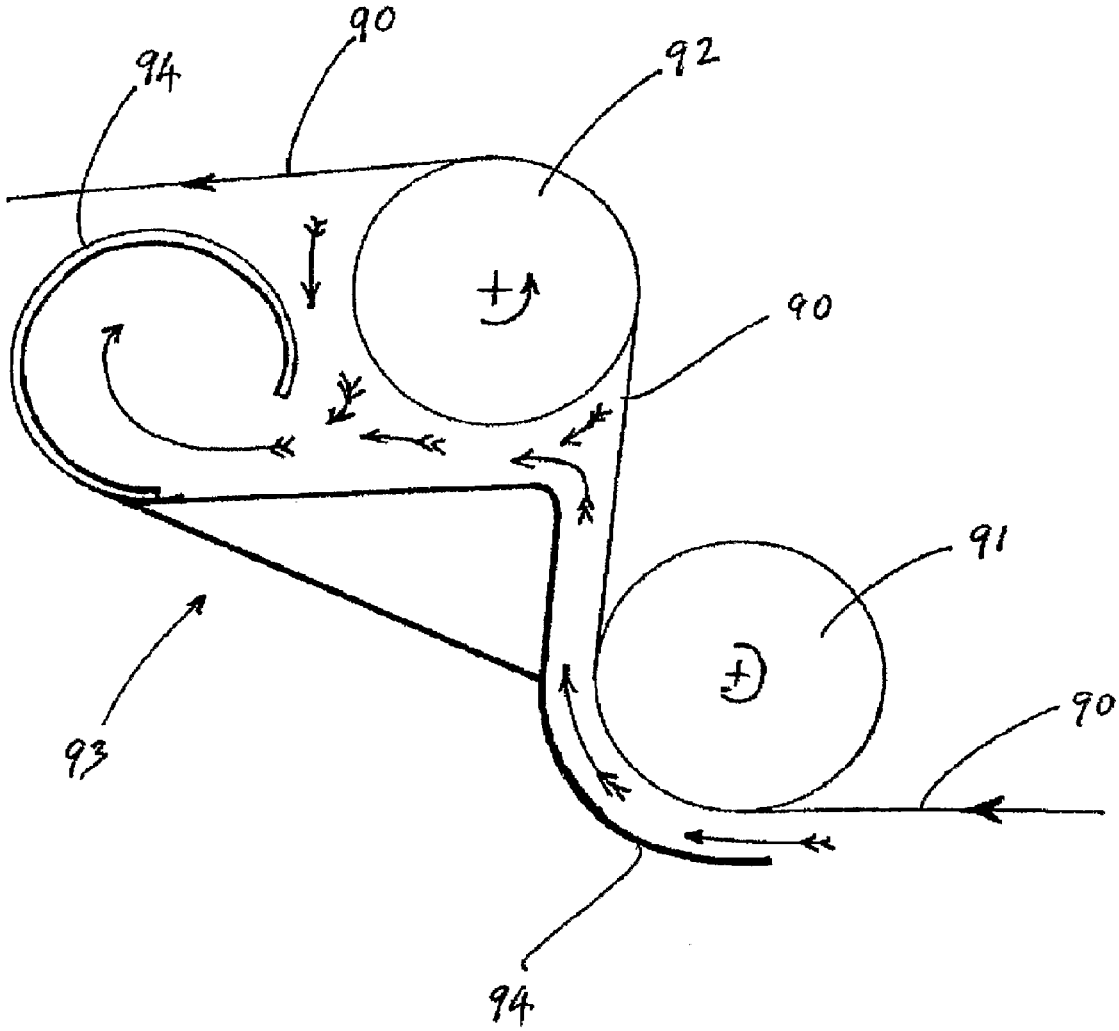
FIG. 12 is a cross-sectional view (looking transversely across a web) of yet another hood in association with rollers and the web.

A guide such as guide 202 may be combined with a hood. As an example, FIG. 12 shows in cross-section a web 90 passing over two rollers 91 and 92, with a hood 93, of the same type as hood 80, being provided for dust removal around roller 92. A guide 94 is provided to guide dust laden air moving with web 90 over roller 91 so that it can be sucked into duct 94 of hood 93.

Figure 8:
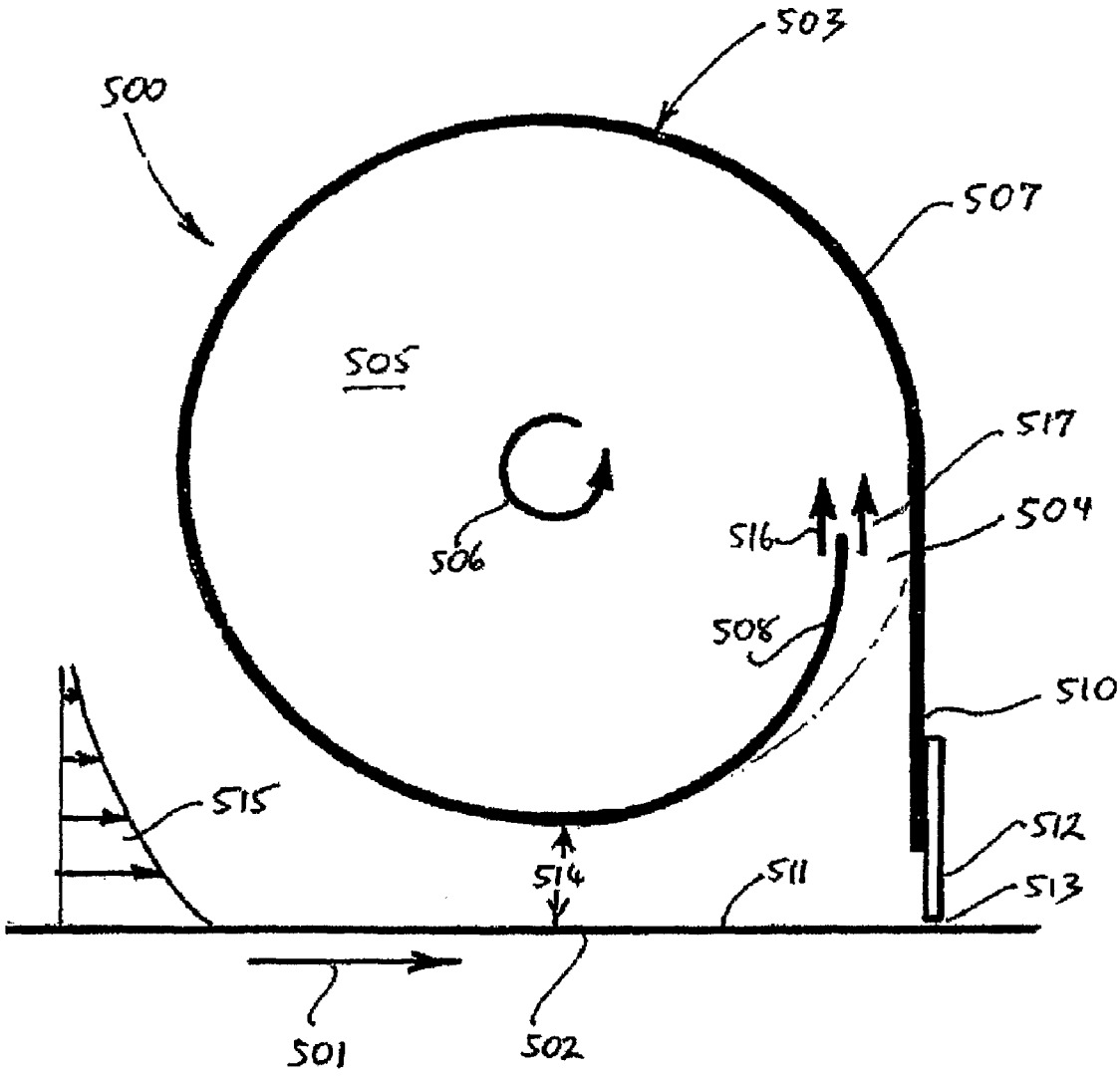
FIG. 8 is a cross-sectional view (looking transversely across a web) of a further dust removal apparatus according to the invention.

FIG. 8 shows a simpler hood 500 than those discussed above, and that should be found suitable in many applications. Hood 500 is shown in cross-section and extends transversely to the direction of travel (shown by arrow 501) of a web 502. Hood 500 comprises a duct 503 generally of tubular form but with a tapering flow passage 504 by which air and dust are sucked into an inner space 505 of duct 503. As in the other hoods described above, flow passage 504 is positioned so that air enters space 505 tangentially, encouraging a vortex flow pattern in the direction indicated by arrow 506 superimposed on the axial flow created by an air exhausting means (not shown, and of any suitable known type). Duct 503 has a wall 507 that is substantially circular and smooth inside, except for a first wall section 508 that blends with wall 507 and curves inwardly into space 505, ending at a free edge or lip 509, and a second wall section 510 that extends wall 507 downward (as shown) in a tangential direction. Second wall section 510 extends almost to web surface 511 and is fitted (as an option) with a wad collector 512. The gap 513 between wad collector 512 and surface 511 is smaller than gap 514 between wall 507 and surface 511, so that gap 514 forms a "mouth" into which dust entrained in boundary layer 515 passes.

The first wall section 508 is found to be able to provide better performance of the hood 500 than if it is absent. First wall section 508 is preferably shaped and sized (using results from suitable testing, computer simulation or the like) so that air inside the space 505 and passing lip 509 (indicated as to its direction by arrow 516) and air in passage 504 passing lip 509 (indicated as to its direction by arrow 517) travel in approximately the same directions, parallel to first wall section 508 at lip 509. This condition is believed to work well.

It will be appreciated that hood 500 can be very simply constructed. Duct 503 could for example be formed from a tube (for example an extrusion, preferably an aluminum alloy extrusion) by cutting lengthwise and bending the wall 507 inward (form the position shown in chain-dotted line) to form wall section 508. Second wall section 510 is then secured to the unbent part of wall 507 to obtain the shape shown in FIG. 8. The width of passage 504 can be set to suit the application, and even bent so as to vary in width along its length to provide for a desired variation of mass flow rate of air per unit length of duct along the duct length, for example a constant rate.

Hood 500 has been described by reference to a cross-section, however, it should be understood that its ends may be treated similarly to the other hoods described, for example hood 1. For example an end may have a blanking plate or a exhaust connection, and may be supported by a mechanical actuator (all not shown).

As with all the other hoods described herein, by suitable design, including choice of air extraction rate, substantially all or a specified proportion of the "boundary layer air can be drawn into the space 505, with its entrained dust for removal.

Many variations and extensions of the concepts set out herein will be readily apparent to persons skilled in the art and may be made without departing from the spirit or scope of the present invention.

Figure 7:
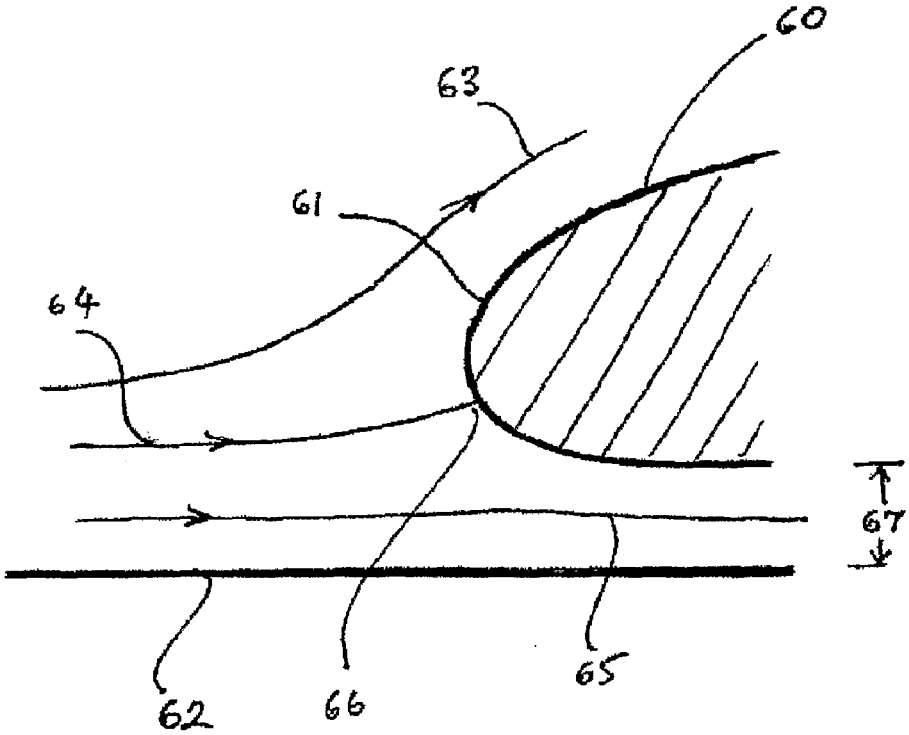
FIG. 7 is a cross-sectional sideways-looking view of a still further hood leading section and a web.

For example, referring back to hood 1, it is believed that in at least some circumstances a rounded leading edge may be preferable to a sharp leading edge such as leading edge 21. FIG. 7 shows a front part of a hood 60 having a rounded leading edge 61, positioned over a moving web 62. Streamlines 63, 64 and 65 are shown, representing flow generated by motion of the web 62. Streamline 63 represents flow that stays outside hood 60 and streamline 65 shows flow passing into the hood 60. Streamline 64 is a streamline that ends at a stagnation point 66 on edge 61. It is thought that for example where a variable web-to-edge gap 67, or a variable suction rate is required to deal with different conditions or product types, leading edge 61 may be less prone than a sharper one to accumulate dust on the exterior of hood 60 and may reduce energy losses.

Figure 13:
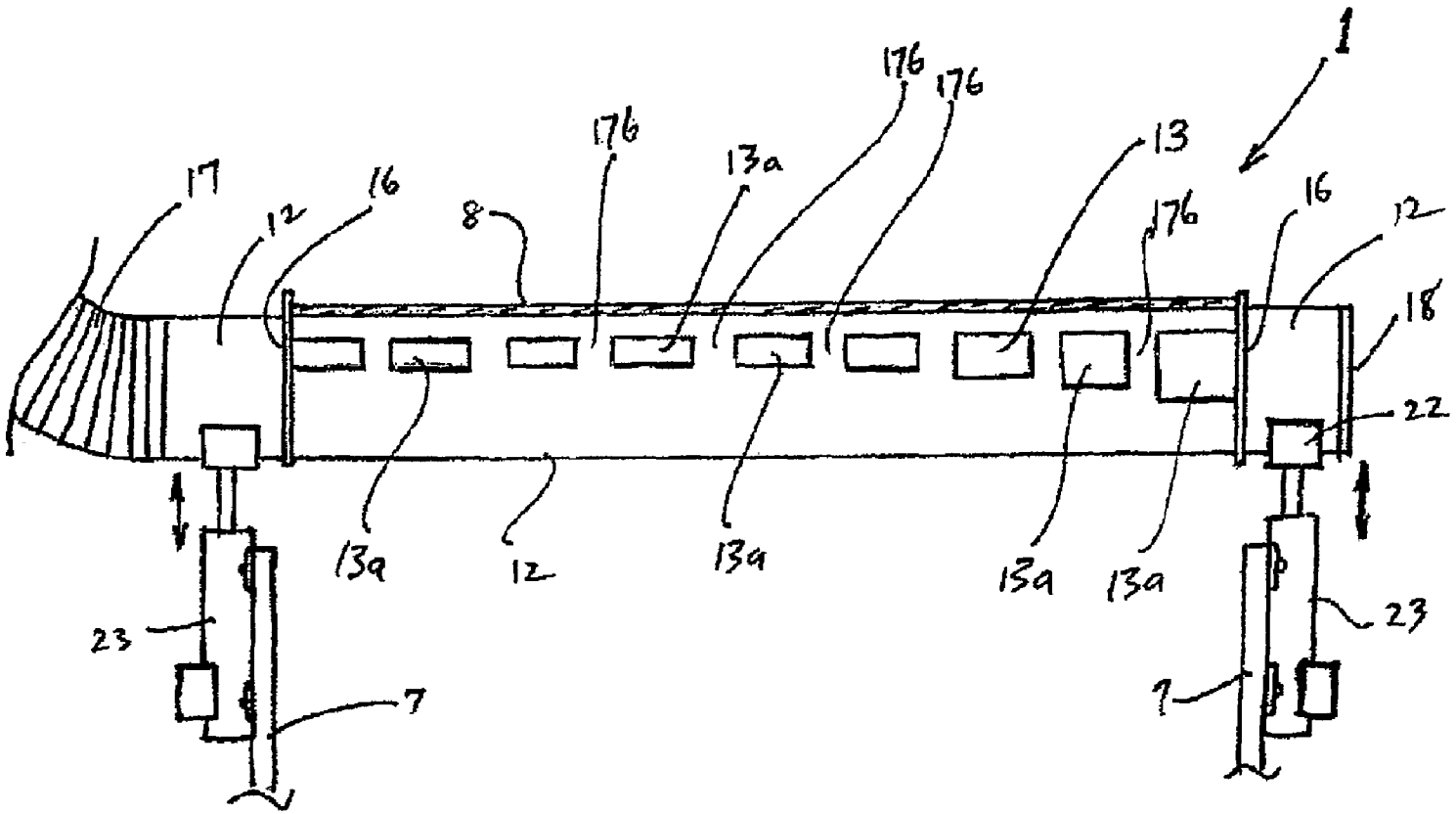
FIG. 13 is a view of a modified version of the hood shown in FIG. 3 as seen from the same viewpoint as FIG. 3.

Another variation appears also to have potential importance. In the various hoods described herein, elongate slots are provided whereby air enters a duct that forms part of a hood assembly. These may be of variable width. For example in hood 1, air enters elongate duct 12 through a slot 13 that extends substantially along its length. Similarly, as other examples, hood 70 has a slot 74 by which air enters duct 73, and hood 50 has a slot 174 by which air enters duct 175. It is desirable in many cases, particularly where there are no end plates in use such as end plates 16 of hood 1 or end-positioned blocking plates (not shown) as mentioned above in relation to hood 1, that the slot width vary along its length. See FIG. 4, where a variable width is shown in respect of slot 13 of hood 1. Variable width slots such as slot 13 can be quite expensive and difficult to provide. However, it has been found possible to provide more simply and cheaply made slots with only a surprisingly small degradation of performance. This can be done by approximating a single elongate slot with a plurality of shorter slots arranged lengthwise of the duct in question and separated by webs. By way of example, FIG. 13 shows a hood la that is the same in every respect to hood 1 except that it has a modified slot arrangement. FIG. 13 is the same view of hood la as FIG. 4 is of hood 1, with identical item numbers used for identical parts for convenience. Instead of the single duct 13 of hood 1 there is an array of shorter slots 13*a* separated by webs 176. Each slot 13*a* has a constant width (i.e. in the peripheral direction of duct 12), but these widths vary from slot 13*a* to slot 13*a*, so that the effect of the variable width of slot 13 is approximated. It has been found that satisfactory performance can be obtained, with much easier and cheaper fabrication. It is of course possible to make the lengths of such multiple slots differ one from another, and to make the widths of individual slots variable within their own length, still with some dividends in ease and simplicity of fabrication, and potentially with improved performance. There is no requirement to limit such arrays of slots to quadrilateral slots: individual slots may be of differing shapes, for example an individual slot that is part of an array could have semicircular ends (not shown). Still further, a variable (or, for that matter, constant) width elongate slot can be approximated by an array of openings that are not sufficiently elongate to amount to slots, for example an array of circular holes. This general principle can be applied to slots and air passages generally of hoods according to the invention where such slots would otherwise be made with variable width along a substantial length.

The use of multiple slots or openings described by reference to FIG. 13 is also able to apply to the simple hood 500.

Still further variations will readily suggest themselves to persons skilled in the art that remain within the spirit and scope of the inventions as described herein.

In this specification, the words, "comprise", "comprises", and "comprising", used in relation to a specified set of integers, elements or steps are to be taken as meaning that the integers, elements or steps are present, but not as precluding the possibility of other integers, elements or steps being present.

The invention claimed is:

1. A dust collection installation for equipment in which a continuous web is transported along its length and passes over a cylindrical roller, wherein said dust collection installation includes apparatus that comprises:

(a) an elongate duct that extends in a direction transverse to a direction of movement of the web and that permits entry of air into the duct along the length thereof through at least one opening provided in the duct; and (b) air extracting means in fluid communication with the duct to draw air therefrom, and wherein:

(c) said apparatus is positioned adjacent to a moving surface of the web so that said apparatus and the moving web surface define an air inlet and a space between the apparatus and the moving web surface into which air inlet and space is received at least a proportion of a layer of dust laden air adjacent to and moving with the moving web surface;

(d) said air extracting means is operable to draw dust laden air from said space into the duct; and (e) said apparatus is positioned on the same side of the web as a roller which the web contacts and passes over and the or a said opening is so positioned that air flow into that opening is augmented by a jet of air generated where the moving web surface converges with and then comes into contact with a surface of the roller.

2. The dust collection installation of claim 1, wherein air enters the duct in a direction approximately tangential to an inner surface of the duct whereby to promote rotational movement about the length of the duct of air that is drawn along the duct.

3. The dust collection installation of claim 1, wherein the or a said opening comprises a slot that is elongate in the lengthwise direction of the duct and that varies in width along the length of the slot.

4. The dust collection installation of claim 1, having a plurality of said openings and wherein members of the plurality of openings are of different sizes.

5. The dust collection installation of claim 3, wherein said slot is so proportioned that in use with a specified total air flow rate into the duct and for a specified position of the apparatus relative to the moving web surface a specified distribution of air flow rate into the duct per unit duct length is obtained along the length of the duct.

6. The dust collection installation of claim 4, wherein said openings are so proportioned that in use with a specified total air flow rate into the duct and for a specified position of the apparatus relative to the moving web surface a specified distribution of air flow rate into the duct per unit length is obtained along the length of the duct.

7. The dust collection installation of claim 1, wherein the air extracting means is in fluid communication with the duct at either end or both ends of the duct.

8. The dust collection installation of claim 1, wherein said apparatus further comprises an upstream formation elongate in the direction along the length of the duct, the upstream formation and the moving web surface defining said space between the apparatus and the moving web surface, the upstream formation being encountered by a point on the moving surface before the point passes a said opening of the duct.

9. The dust collection installation of claim 8, wherein the upstream formation has a leading edge defined by upper and lower surfaces that diverge backwardly from said leading edge and a gap between the leading edge and the moving web surface is so chosen that a specified proportion of a layer of dust laden air moving with the web passes through the gap.

10. The dust collection installation of claim 1, wherein said apparatus is supported by movable support means whereby said apparatus is movable relative to the moving web surface.

11. The dust collection installation of claim 9, wherein the said proportion is more than about 80%.

12. A method for limiting dust concentration in machinery in which a continuous web is transported along its length and passes over a cylindrical roller, comprising firstly the step of providing apparatus that comprises:

(a) an elongate duct that extends in a direction transverse to a direction of movement of the web and that permits entry of air into the duct along the length thereof through at least one opening provided in the duct; and (b) air extracting means in fluid communication with the duct to draw air therefrom, and secondly positioning said apparatus adjacent to a moving surface of the web so that said apparatus and the moving web surface define an air inlet and a space between the apparatus and the moving web surface into which air inlet and space is received at least a proportion of a layer of dust laden air adjacent to and moving with the moving web surface;

and thirdly operating said air extracting means to draw dust laden air from said space into the duct;

and fourthly positioning said apparatus on the same side of the web as a roller which the web contacts and passes over and with the or a said opening so positioned that air flow into that opening is augmented by a jet of air generated where the moving web surface converges with and then comes into contact with a surface of the roller.

13. The dust collection installation of claim 5 wherein the air flow rate into the duct per unit length is uniform along the length of the duct.

14. The dust collection installation of claim 6 wherein the air flow rate into the duct is uniform along the length of the duct.

15. The dust collection installation of claim 1 wherein the jet of air is directed into the or a said opening.

16. The dust collection installation of claim 9 wherein said upstream formation comprises a portion having a surface that faces the moving web surface and that is shaped to extend said space around a curved portion of the moving web surface where the web changes direction by passing over a second roller positioned on an opposite side of the web and ahead of the roller that generates the air jet whereby said portion limits outward spread of dust due to passage of the web over said second roller.

17. Apparatus for dust collection in equipment in which a continuous web is transported along its length and passes over a cylindrical roller, said apparatus comprising:

(a) an elongate duct that extends in a direction transverse to a direction of movement of the web and that permits entry of air into the duct along the length thereof through at least one opening provided in the duct; and (b) air extracting means in fluid communication with the duct to draw air therefrom, and wherein:

(c) said apparatus is positionable adjacent to a moving surface of the web so that said apparatus and the moving web surface define an air inlet and a space between the apparatus and the moving web surface into which air inlet and space is received at least a proportion of a layer of dust laden air adjacent to and moving with the moving web surface;

(d) said air extracting means is operable to draw dust laden air from said space into the duct; and (e) said apparatus is positionable on the same side of the web as a roller which the web contacts and passes over so that air flow into the or a said opening is augmented by a jet of air generated where the moving web surface converges with and then comes into contact with a surface of the roller.

* * * * *